US009033729B2

(12) United States Patent
Klein et al.

(10) Patent No.: US 9,033,729 B2
(45) Date of Patent: May 19, 2015

(54) PANEL MOUNTED CONNECTOR ASSEMBLY

(71) Applicant: Tyco Electronics Corporation, Berwyn, PA (US)

(72) Inventors: David Allen Klein, Kernersville, NC (US); Rohan Narang, High Point, NC (US); Kevin John Peterson, Kernersville, NC (US); Robert Daniel Irlbeck, Greensboro, NC (US); Ronald Louis Marion, Yadkinville, NC (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 190 days.

(21) Appl. No.: 13/749,473

(22) Filed: Jan. 24, 2013

(65) Prior Publication Data

US 2013/0196537 A1 Aug. 1, 2013

Related U.S. Application Data

(60) Provisional application No. 61/632,581, filed on Jan. 26, 2012.

(51) Int. Cl.

| | |
|---|---|
| ***H01R 13/73*** | (2006.01) |
| ***H01R 13/62*** | (2006.01) |
| ***H01R 13/74*** | (2006.01) |

(52) U.S. Cl.

CPC ..... *H01R 13/62* (2013.01); *H01R 13/74* (2013.01); *H01R 13/743* (2013.01)

(58) Field of Classification Search

USPC ..... 439/563, 544, 549, 550, 552, 557

See application file for complete search history.

(56) References Cited

U.S. PATENT DOCUMENTS

| | | | | | |
|---|---|---|---|---|---|
| 5,037,325 | A * | 8/1991 | Wirkus | 439/467 |
| 5,181,865 | A | 1/1993 | Hayes, Sr. | |
| 5,391,086 | A * | 2/1995 | Woller et al. | 439/157 |
| 5,607,323 | A * | 3/1997 | Foster et al. | 439/557 |
| 5,660,564 | A * | 8/1997 | Yamanashi et al. | 439/557 |
| 5,904,584 | A * | 5/1999 | Flask et al. | 439/157 |
| 6,126,484 | A * | 10/2000 | Klein et al. | 439/595 |
| 6,247,966 | B1 * | 6/2001 | Klein et al. | 439/595 |

(Continued)

FOREIGN PATENT DOCUMENTS

| | | |
|---|---|---|
| EP | 1 032 091 A1 | 8/2000 |
| EP | 1 710 874 A2 | 10/2006 |

OTHER PUBLICATIONS

International Search Report, International Application No. PCT/US2013/023091, International Filing Date, Jan. 25, 2013.

*Primary Examiner* — Tho D Ta
*Assistant Examiner* — Travis Chambers

(57) ABSTRACT

A connector assembly for mounting to a panel includes a cap connector having a cap housing, a cap terminal block held in the cap housing and holding a plurality of cap terminals and a mounting clip coupled to the cap housing to secure the cap housing to the panel. The cap housing has an inner shroud, an inner flange surrounding the inner shroud and an outer flange extending outward from the inner flange. The inner flange has panel retention features extending therefrom. The inner shroud is loaded through an opening in the panel until the panel retention features engage the panel and temporarily secure the cap housing to the panel between the panel retention features and the outer flange. The mounting clip is coupled to the cap housing to secure the cap housing to the panel between the mounting clip and the outer flange.

20 Claims, 10 Drawing Sheets

(56) References Cited

U.S. PATENT DOCUMENTS

| | | | | |
|---|---|---|---|---|
| 7,384,303 | B2 * | 6/2008 | Murakami et al. | 439/557 |
| 7,520,764 | B2 * | 4/2009 | Lee et al. | 439/153 |
| 2003/0014850 | A1 | 1/2003 | Banitt et al. | |
| 2009/0088021 | A1 * | 4/2009 | Kauffman et al. | 439/552 |
| 2010/0130059 | A1 | 5/2010 | Lee et al. | |
| 2012/0115357 | A1 * | 5/2012 | Lee et al. | 439/569 |

* cited by examiner

PANEL MOUNTED CONNECTOR ASSEMBLY

CROSS REFERENCE TO RELATED APPLICATIONS

This application claims the benefit of U.S. Provisional Application No. 61/632,581 filed Jan. 26, 2012, the subject matter of which is herein incorporated by reference in its entirety.

BACKGROUND OF THE INVENTION

The subject matter herein relates generally to electrical connectors mounted to a panel.

Various problems exist when using panel mounted connectors. For instance, when installing electrical connectors into a mounting panel, the weight of the wire bundle and connector may cause the connector to fall out of the mounting hole. Temporary retention devices are often needed to properly install and mate the connector. A second installer may be required to place a retention device from the opposite side of the panel while the first installer holds the connector in position. Or, when mating two connectors together, the connectors without temporary retention latches may fall away from the mating part before the connectors can be hand mated or mated with a mechanical assist such as a lever. Additionally, current panel retention features typically do not have the capability to handle multiple panel thicknesses.

Other problems mounting a connector to a panel include the use of special tools (torque wrench, etc.) or a large access area for applying a locking ring or slide-clip to retain the connector to a panel. For example, existing designs utilizing side-clips have retention ribs running the entire length of the clip and connector requiring the total access area zone to be twice the size of the connector alone.

Other connector design problems are that the terminal position assurance (TPA) staging and retention latches are often unable to be directly disengaged. Additionally, the latch beam design can require very high elongation of the material properties for the hinges to flex but not break.

Current connectors also rely on the overall fit between the components of the mating connectors to stabilize the design during high vibration.

BRIEF DESCRIPTION OF THE INVENTION

In one embodiment, a connector assembly is provided for mounting to a panel that includes a cap connector having a cap housing, a cap terminal block held in the cap housing and holding a plurality of cap terminals and a mounting clip coupled to the cap housing to secure the cap housing to the panel. The cap housing has an inner shroud, an inner flange surrounding the inner shroud and an outer flange extending outward from the inner flange. The inner flange has panel retention features extending therefrom. The inner shroud is loaded through an opening in the panel until the panel retention features engage the panel and temporarily secure the cap housing to the panel between the panel retention features and the outer flange. The mounting clip is coupled to the cap housing to secure the cap housing to the panel between the mounting clip and the outer flange.

Optionally, the panel retention features may include a plurality of ribs independently movable with respect to one another and detents extending from corresponding ribs. The detents may be configured to engage the panel to secure the cap housing to the panel. The panel retention features may be staged at different distances from the outer flange to accommodate different panel thicknesses. Optionally, the cap housing may be more securely coupled to the panel by the mounting clip as compared to the panel retention features.

Optionally, the mounting clip may be front loaded over the inner shroud in a loading direction generally toward the outer flange. The mounting clip may be front loaded until the mounting clip abuts the panel. The mounting clip may be moved in a securing direction generally perpendicular to the loading direction. The securing direction may be generally parallel to the outer flange. The mounting clip may be pressed toward the outer flange as the mounting clip is moved in the securing direction. The mounting clip may include an opening therethrough bounded by an upper wall, a lower wall, a first side wall and a second side wall extending between the upper and lower walls. The inner shroud may pass through the opening.

Optionally, the inner shroud may include detents spaced apart from the outer flange. The mounting clip may be loaded over the inner shroud until the mounting clip is positioned against the panel. The mounting clip may be slid along the panel to engage the detents and secure the cap housing to the panel.

In another embodiment, a connector assembly is provided for mounting to a panel that includes a cap connector comprising a cap housing, a cap terminal block held in the cap housing and holding a plurality of cap terminals and a cap terminal position assurance (TPA) device held in the cap housing. The cap housing is secured to the panel using a mounting clip. The cap terminal block has terminal channels receiving the cap terminals. The cap terminal block has deflectable latches securing the cap terminals in the terminal channels. The cap terminal block has detents extending from sides of the cap terminal block. The cap TPA device has support walls extending into the cap terminal block to support the latches and restrict release of the latches when the support walls are in a blocking position. The cap TPA device has hinged latches extending from sides of the cap TPA device. The cap TPA device is coupled to the cap terminal block such that the hinged latches engage corresponding detents of the cap terminal block. The hinged latches are configured to be released from the detents to uncouple the cap TPA device from the cap terminal block. The support walls are moved out of the blocking position when the cap TPA is uncoupled from the cap terminal block allowing the latches of the cap terminal block to release to remove the cap terminals from the terminal channels.

Optionally, the latches may each include a strap supported by multiple hinges where the strap engages the corresponding detents. The latches may be connected to the corresponding sides at multiple connection points. Each side of the cap terminal block may include a plurality of detents arranged in a stacked configuration at different distances from the front of the cap terminal block. The latches engaging the detents to hold the cap TPA at different staged positions.

In another embodiment, a connector assembly is provided for mounting to a panel including a cap connector and a plug connector. The cap connector includes a cap housing, a cap terminal block held in the cap housing and holding a plurality of cap terminals and a cap terminal position assurance (TPA) device. The cap TPA device is coupled to the cap terminal block and supports the cap terminals in the cap terminal block. The cap terminal block has stabilizing posts extending therefrom that extend through the cap TPA. The cap housing is secured to the panel using a mounting clip. The plug connector is coupled to the cap connector. The plug connector includes a plug housing, a plug terminal block held in the plug housing and holding a plurality of plug terminals and a plug terminal position assurance (TPA) device. The plug TPA device is coupled to the plug terminal block and supports the plug terminals in the plug terminal block. The plug housing is secured to the cap housing with the plug terminals mated with corresponding cap terminals and with the stabilizing posts of the cap connector extending into the plug TPA and the plug terminal block to align and secure the cap terminal block to the plug terminal block.

DETAILED DESCRIPTION OF THE INVENTION

Figure 1:
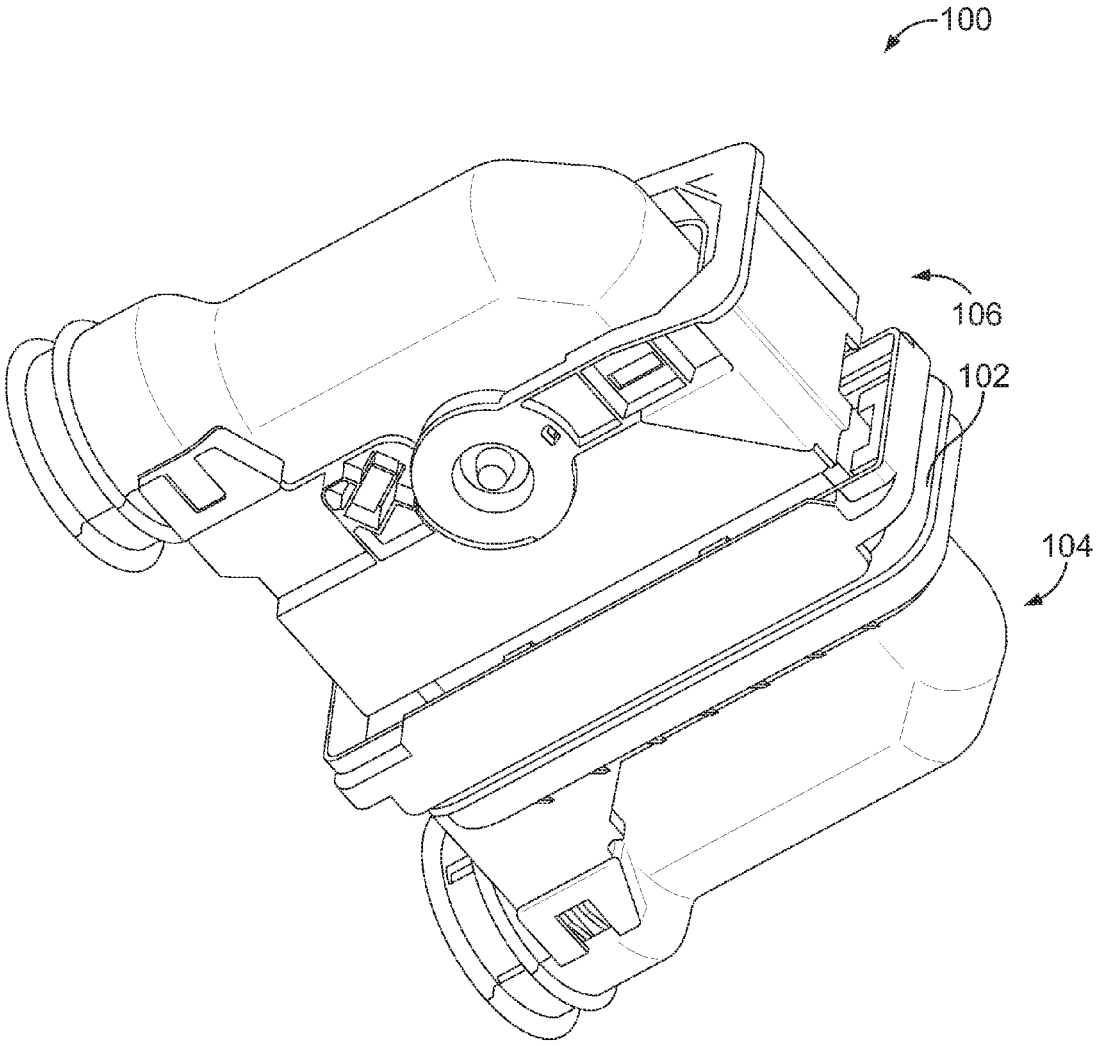
FIG. 1 is an isometric view of a connector assembly formed in accordance with an exemplary embodiment.

FIG. 1 is an isometric view of a connector assembly 100 formed in accordance with an exemplary embodiment. The connector assembly 100 is configured to be panel mounted to a panel 102, such as a chassis, bulkhead, casing, and the like of a vehicle or machine. The connector assembly 100 is durable and capable of use in outdoor, rugged or extreme environments.

The connector assembly 100 includes a cap connector 104 and a plug connector 106. In an exemplary embodiment, the cap connector 104 is configured to be mounted to the panel 102 and the plug connector 106 is configured to be mated with the cap connector 104.

Embodiments of the connector assembly 100 described herein provide a tool-less mounting arrangement. Embodiments of the connector assembly 100 provide temporary retention features that allow proper positioning and orientation of components, which may be further secured at a later time to complete the mating of the connectors 104, 106. Embodiments described herein have features that do not require a large access area around the connectors 104, 106 for assembly, allowing the connector assembly 100 to be positioned closer to other components or mounted into a smaller area of the panel 102. Embodiments of the connector assembly 100 provide features used to stabilize the terminal blocks of the cap and plug connectors 104, 106, thus reducing vibration and/or damage to the terminals of the connectors 104, 106. Embodiments of the connector assembly 100 allow for release of terminal position assurance (TPA) latches used to hold terminals in terminal blocks for ease of use. Embodiments of the connector assembly 100 provide a low stress hinge design for connection of various components that will work with a wide variety of materials.

Figure 2A:
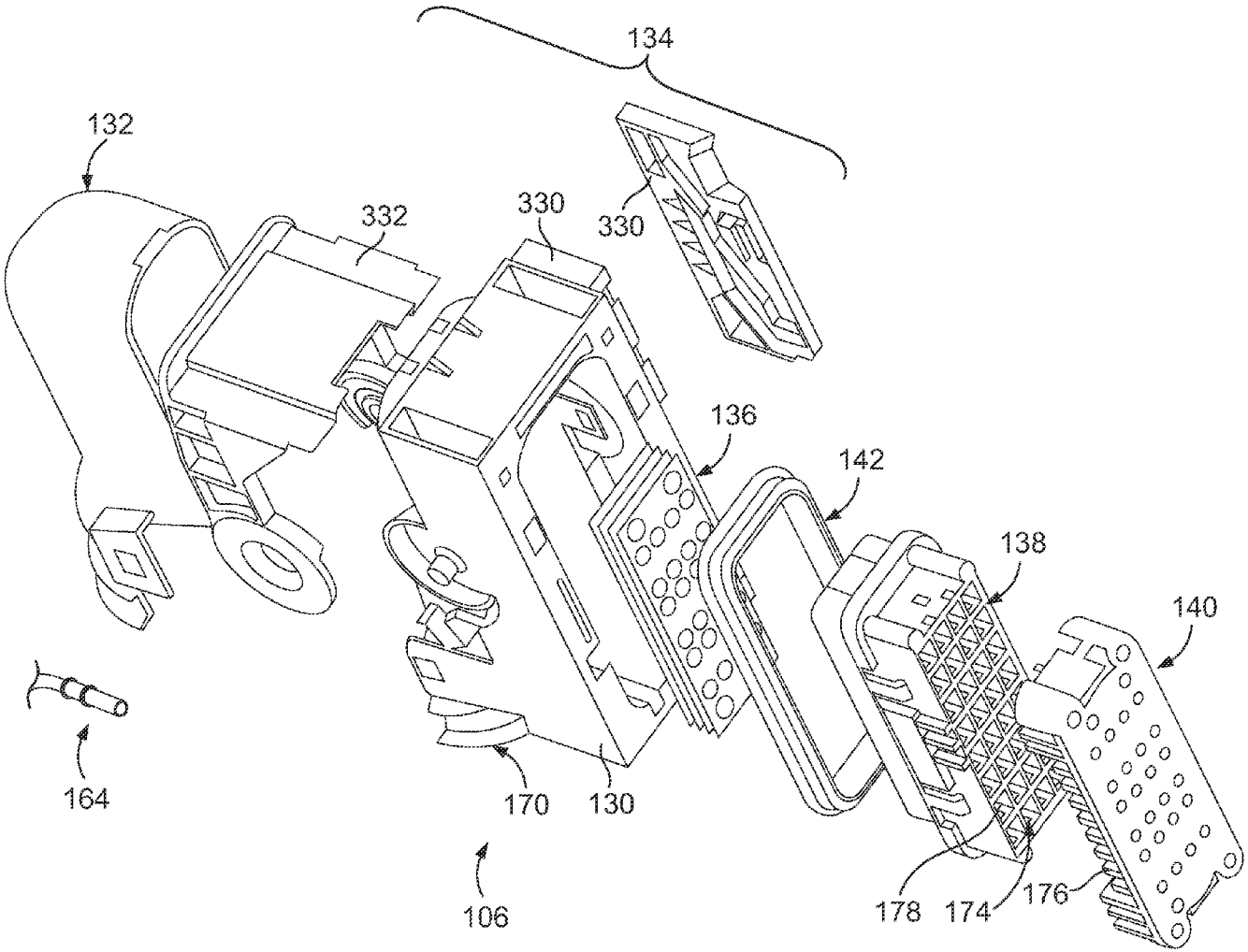
FIGS. 2*a* and 2*b* show an exploded view of the connector assembly showing a cap connector and a plug connector thereof.
Figure 2B:
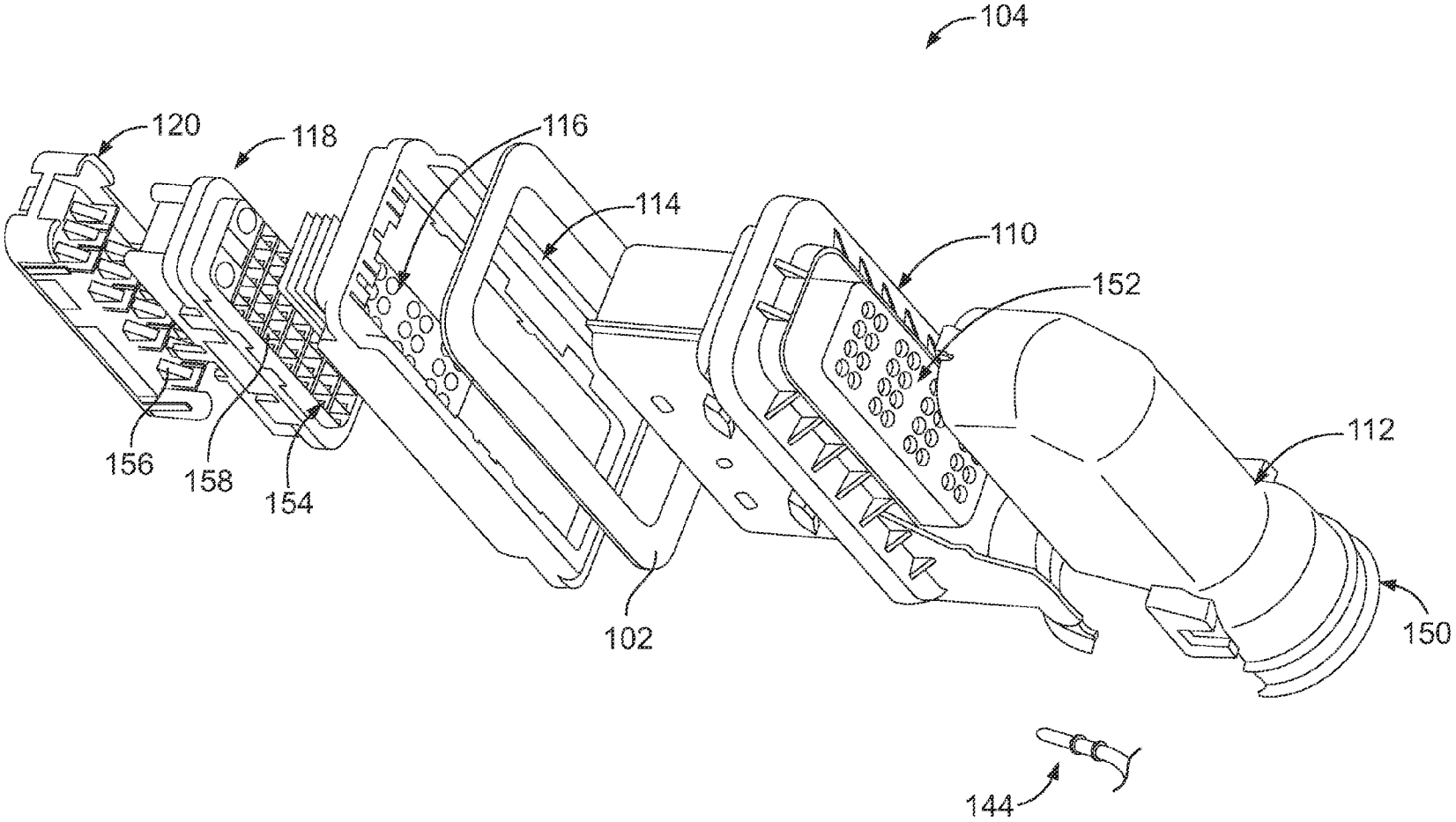

FIGS. 2*a* and 2*b* show an exploded view of the connector assembly 100 showing the cap connector 104 and the plug connector 106. In an exemplary embodiment, the cap connector 104 includes a cap housing 110, a wire cover 112, a mounting clip 114, a wire seal 116, a cap terminal block 118 and a cap TPA device 120. In an exemplary embodiment, the plug connector 106 includes a plug housing 130, a wire cover 132, a slide lock mechanism 134, a wire seal 136, a plug terminal block 138 and a plug TPA device 140. An interface seal 142 is provided which may be positioned between the plug housing 130 and the cap housing 110 to seal the interface between the connectors 104, 106. The cap and plug connectors 104, 106 may include other components in alternative embodiments. The cap and plug connectors 104, 106 may be used without one or more of the components shown in FIGS. 2*a* and 2*b*, such as without the TPA devices 120, 140. Some of the components may be integral with other components rather than being separate components as shown in FIGS. 2*a* and 2*b*.

The cap housing 110 holds wires and/or terminals 144 of the cap connector 104. The wire cover 112 is secured to the back end of the cap housing 110 to cover the wires and direct the wires through a cable exit 150 of the cap connector 104. The cable exit 150 may be defined in part by the cap housing 110 and in part by the wire cover 112. The wire cover 112 diverts high pressure spray, dirt and debris from entering the cap housing 110. In an exemplary embodiment, the cap housing 110 includes channels 152 extending therethrough. The wires and/or terminals 144 may be loaded into the channels 152 and into the cap terminal block 118. The wires extending from the back end of the channels 152 are directed to the cable exit 150 by the wire cover 112.

The cap housing 110 is configured to be mounted to the panel 102. The mounting clip 114 is used to securely couple the cap housing 110 to the panel 102. Other types of retention features may be used to secure the cap housing 110 to the panel 102, such as latches, fasteners, and the like. In an exemplary embodiment, the cap housing 110 may include temporary retention features that temporarily secure the cap housing 110 to the panel 102 until the mounting clip 114 is able to be positioned and secured to the cap housing 110.

During assembly, the wire seal 116, cap terminal block 118 and cap TPA device 120 are loaded into the front end of the cap housing 110. The wire seal 116 seals against the wires associated with the cap terminals 144 of the cap connector 104. The wire seal 116 prevents exposure of the cap terminals 144 to dirt, debris and/or moisture through the cap housing 110. In an alternative embodiment, the cap terminal block 118 may be integral with and held in the cap housing 110 and thus not separately loaded into the cap housing 110.

The cap terminal block 118 is used to hold the cap terminals 144. The cap terminal block 118 may have a plurality of individual cap terminal channels 154 that receive corresponding cap terminals 144. Latches 158 within each cap terminal channel 154 abut and hold the terminals 144 in the cap terminal channels 154. The cap TPA device 120 is coupled to the front of the cap terminal block 118. The cap TPA device 120 includes support walls 156 that extend into the cap terminal block 118. The support walls 156 provide support for the latches 158 in the cap terminal channels 154 to block the latches 158 from releasing, thus ensuring that the cap terminals 144 remain in the cap terminal channels 154. In an exemplary embodiment, the cap TPA device 120 is movable between a blocking position and a retracted position. In the blocking position, the latches 158 are blocked by the support walls 156. In the refracted position, the support walls 156 are moved clear of the latches 158 to allow the latches 158 to release, allowing the cap terminals 144 to be removed from the cap terminal channels 154. Optionally, the cap connector 104 may be used without the cap TPA device 120.

The plug housing 130 holds wires and/or terminals 164 of the plug connector 106. The wire cover 132 is secured to the back end of the plug housing 130 to cover the wires and direct the wires through a cable exit 170 of the plug connector 106. The cable exit 170 may be defined in part by the plug housing 130 and in part by the wire cover 132. The wire cover 132 diverts high pressure spray, dirt and debris from entering the plug housing 130. The wires and/or terminals 164 may be loaded into the plug terminal block 138 from the plug housing 130. The wires are directed to the cable exit 170 by the wire cover 132.

The plug housing 130 is configured to be coupled to the cap housing 110. The slide lock mechanism 134 is used to securely couple the plug housing 130 to the cap housing 110. In an exemplary embodiment, the plug housing 130 may include temporary retention features that temporarily secure the plug housing 130 to the cap housing 110 until the slide lock mechanism 134 is able to be actuated to secure the plug housing 130 to the cap housing 110.

During assembly, the wire seal 136, plug terminal block 138 and plug TPA device 140 are loaded into the front end of the plug housing 130. The wire seal 136 seals against the wires associated with the plug terminals 164 of the plug connector 106. The wire seal 136 prevent exposure of the plug terminals 164 to dirt, debris and/or moisture through the plug housing 130. In an alternative embodiment, the plug terminal block 138 may be integral with and held in the plug housing 130 and thus not separately loaded into the plug housing 130.

The plug terminal block 138 is used to hold the plug terminals. The plug terminal block 138 may have a plurality of individual plug terminal channels 174 that receive corresponding plug terminals. Latches 178 within each plug terminal channel 174 abut and hold the terminals in the plug terminal channels 174. The plug TPA device 140 is coupled to the front of the plug terminal block 138. The plug TPA device 140 includes support walls 176 that extend into the plug terminal block 138. The support walls 176 provide support for the latches 178 in the plug terminal channels 174 to block the latches 178 from releasing, thus ensuring that the plug terminals remain in the plug terminal channels 174. In an exemplary embodiment, the plug TPA device 140 is movable between a blocking position and a retracted position. In the blocking position, the latches 178 are blocked by the support walls 176. In the retracted position, the support walls 176 are moved clear of the latches 178 to allow the latches 178 to release, allowing the plug terminals to be removed from the plug terminal channels 174. Optionally, the plug connector 106 may be used without the plug TPA device 140.

Figure 3:
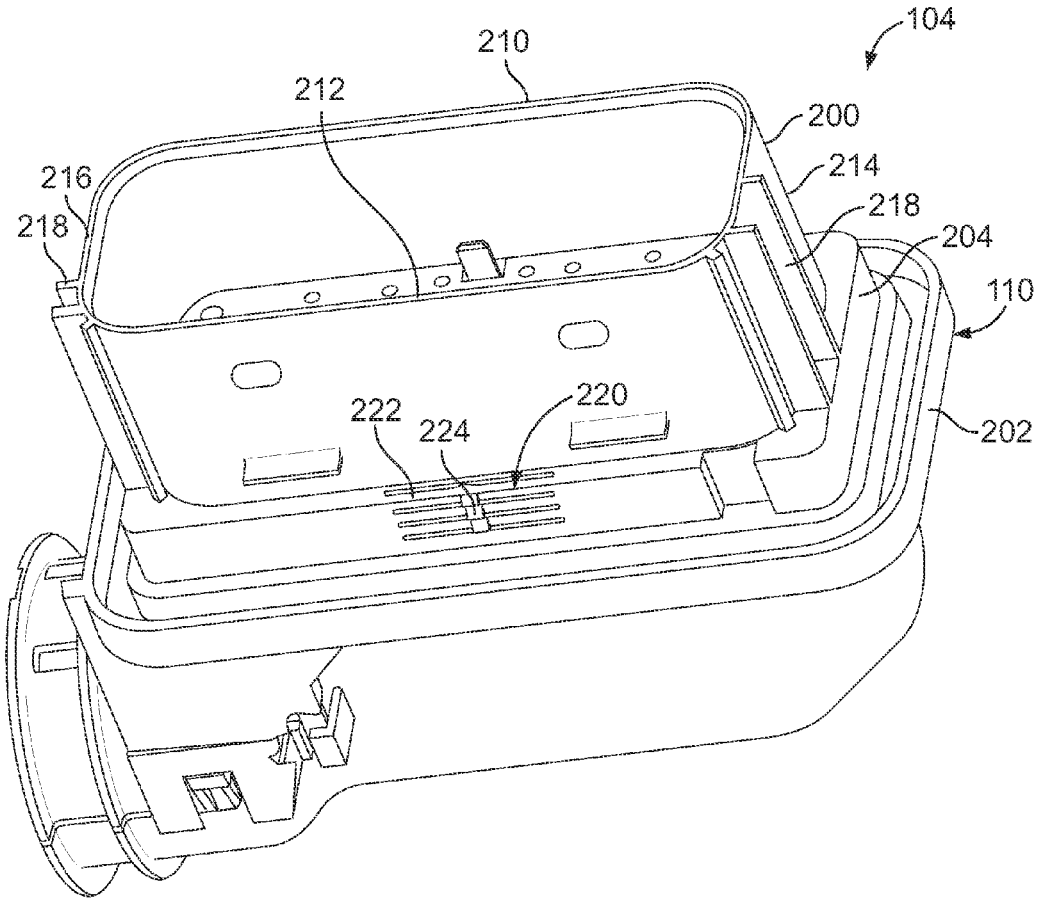
FIG. 3 is an isometric view of a cap housing of the cap connector.

FIG. 3 is an isometric view of the cap housing 110. The cap housing 110 includes an inner shroud 200 at a front of the cap housing 110 and an outer flange 202 proximate to a rear of the cap housing 110.

In an exemplary embodiment, the cap housing 110 includes an inner flange 204 between the inner shroud 200 and the outer flange 202. The inner flange 204 surrounds the inner shroud 200. Optionally, the inner flange 204 may have a different periphery than the inner shroud 200. For example, the inner flange 204 may be thicker than the inner shroud 200. The inner flange 204 may extend outward from one or more sides of the inner shroud 200. The inner flange 204 may have a different shape than the inner shroud 200.

In the illustrated embodiment, the inner shroud 200 has a generally rectangular shape with rounded corners. The inner shroud 200 may have other shapes in alternative embodiments. The inner shroud 200 includes a top 210, a bottom 212, a first side 214 and a second side 216 opposite the first side 214. The inner shroud 200 includes guide rails 218 along the sides 214, 216. The guide rails 218 may provide keyed mating with the plug connector 106 (shown in FIG. 2*b*).

In the illustrated embodiment, the inner flange 204 has a generally rectangular shape with rounded corners. The inner flange 204 extends outward beyond the top 210, bottom 212, and sides 214, 216. The inner flange 204 includes panel retention features 220 used to temporarily retain the cap housing 110 to the panel 102 (shown in FIGS. 4 and 5). The panel retention features 220 each include a plurality of ribs 222 independently movable with respect to one another and detents 224 extending from corresponding ribs 222. The ribs 222 and detents 224 are staged at different distances from the outer flange 202 to accommodate different panel thicknesses. In an exemplary embodiment, the panel retention features 220 are provided along the top and the bottom of the inner flange 204 generally centrally positioned between the sides thereof. Other locations are possible in alternative embodiments. For example, the panel retention features 220 may be positioned at the corners in addition to or in lieu of being positioned at the centers of the top and the bottom. The panel retention features 220 may be positioned along the sides in addition to or in lieu of being positioned along the top and bottom.

Figure 4:
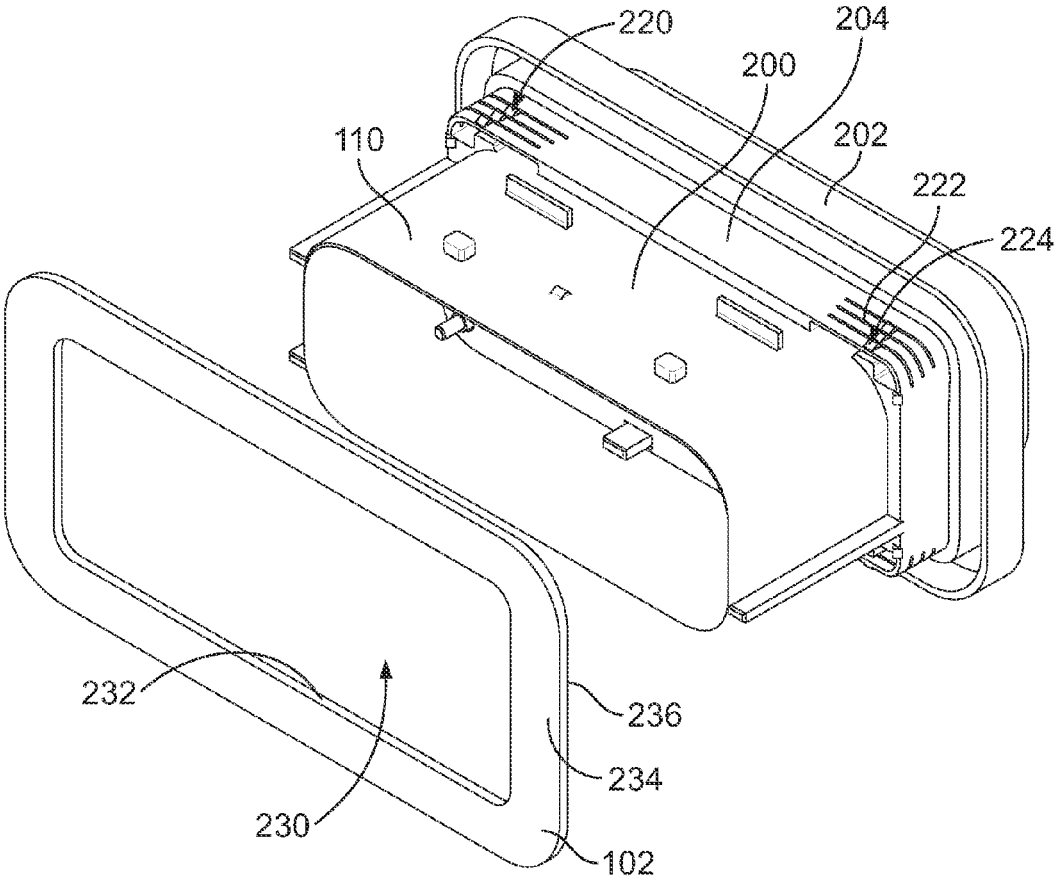
FIG. 4 shows the cap housing being mounted to a panel.
Figure 5:
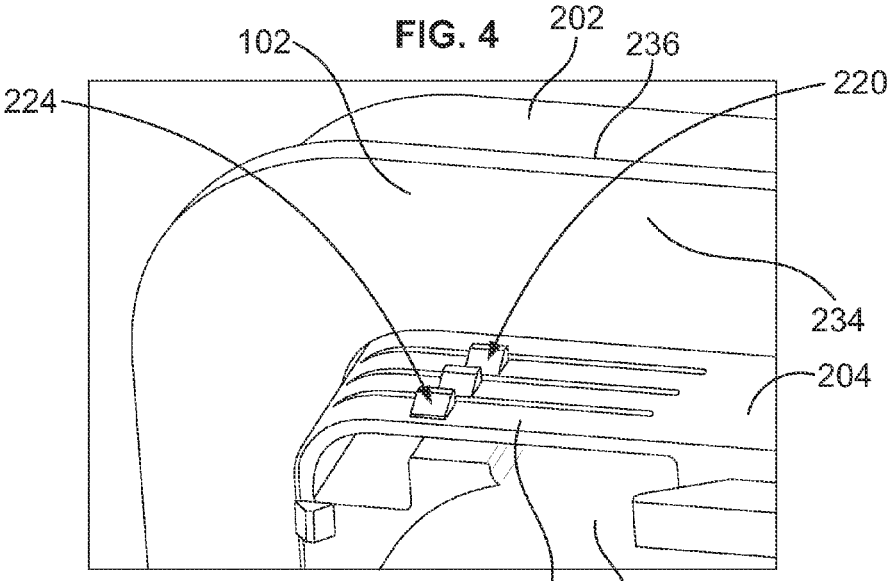
FIG. 5 shows the cap housing mounted to the panel.

FIGS. 4 and 5 show the cap housing 110 being mounted to the panel 102. The panel 102 includes an opening 230 defined by an edge 232. The panel 102 includes a front surface 234 and a rear surface 236. The opening 230 extends between the front and rear surfaces 234, 236. The cap housing 110 is mounted to the panel 102 by loading the inner shroud 200 through the opening 230. As the cap housing 110 is loaded into the opening 230, the panel retention features 220 engage the panel 102 and temporarily retain the cap housing 110 to the panel 102. In the illustrated embodiment, the panel retention features 220 are provided in the corners as opposed to centered along the top and bottom of the inner flange 204. The cap housing 110 may be loaded into the opening 230 until the outer flange 202 engages the rear surface 236 of the panel 102. One or more of the detents 224 engage the front surface 234 (e.g. one detent 224 on the top and one detent 224 on the bottom) such that the cap housing 110 is held in place relative to the panel 102 between the outer flange 202 and the detents 224. The detents 224 may have sufficient strength to hold the cap housing 110 in place without the operator assisting or touching the cap housing 110. As such, the operator is able to use both hands to install the mounting clip 114 (shown in FIG. 2*a*) without needing to also hold the cap housing 110. A second operator is not needed to help install the cap housing 110 in position on the panel 102 as the cap housing 110 is temporarily self supporting.

In an exemplary embodiment, the panel retention features 220 are staged at different distances from the outer flange 202 to accommodate panels of different thicknesses. In the illustrated embodiment, the panel retention feature 220 includes three ribs 222 each with a corresponding detent 224. The ribs 222 are independently movable to allow some flexibility when the detents 224 engage the panel 102. The detents 224 are ramped to allow the detents 224 to easily pass through the opening 230 during assembly. The detents 224 include generally vertical faces that engage the panel 102 and retain the cap housing 110 in position against the panel 102.

Figure 6:
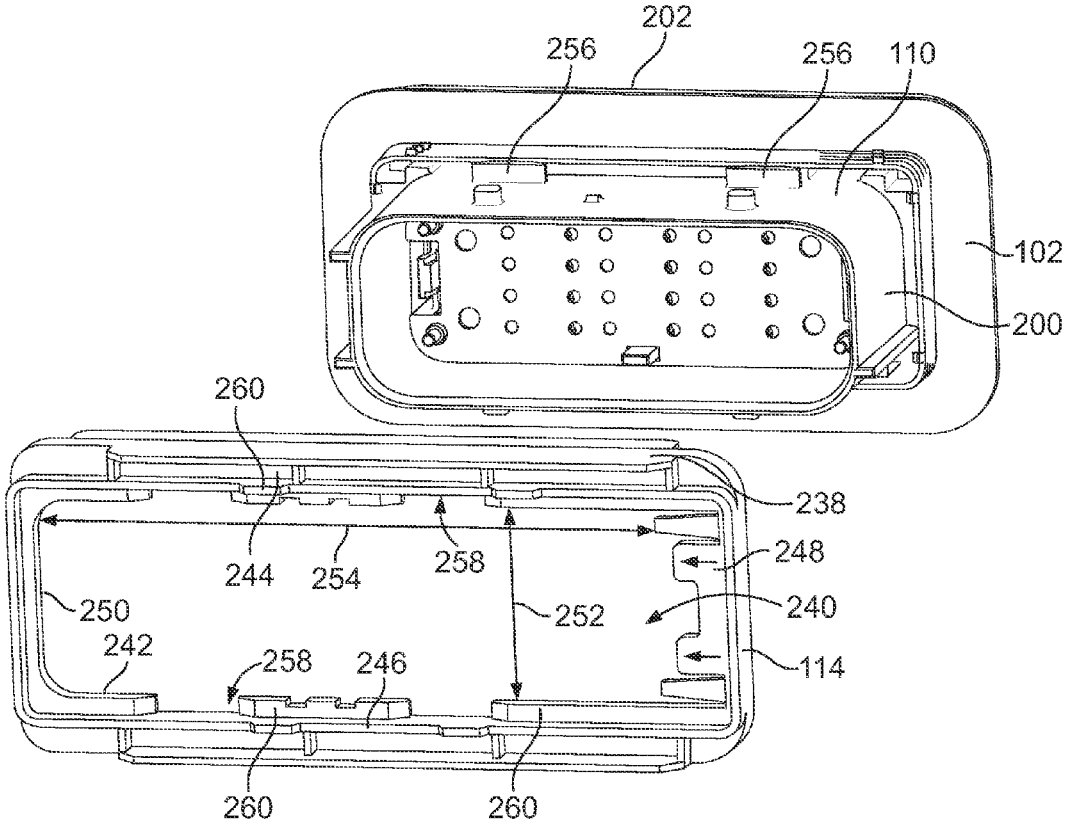
FIG. 6 illustrates a portion of the cap connector showing a mounting clip poised for coupling to the cap housing.

FIG. 6 illustrates a portion of the cap connector 104 showing the cap housing 110 temporarily mounted to the panel 102 and the mounting clip 114 poised for coupling to the cap housing 110. The mounting clip 114 is used to securely couple the cap housing 110 to the panel 102. The mounting clip 114 is designed to pass over the front of the cap housing 110 in a loading direction (e.g. generally toward the outer flange 202 and the panel 102) to engage the panel 102 and then slide along the panel 102 in a securing direction (e.g. generally parallel to the outer flange 202 and the panel 102). As the mounting clip 114 is slid in the securing direction, the cap housing 110 (e.g. the outer flange 202) is pulled tightly against the panel 102. When the mounting clip 114 is secured to the cap housing 110, the cap housing 110 is held tightly against the panel 102 and cannot be removed without removing the mounting clip 114. In contrast, when the panel retention features 220 temporarily retain the cap housing 110 to the panel 102, the cap housing 110 may be pressed out of the opening 230 by overcoming the retaining forces of the detents 224.

The mounting clip 114 is a generally rectangular plate having a flange section 238 surrounding an opening 240. The flange section 238 is configured to be pressed against the panel 102 to secure the cap connector 104 to the panel 102. The opening 240 is surrounded by an edge 242. The edge 242 is defined by an upper wall 244, a lower wall 246, a first side wall 248 and a second side wall 250. The opening 240 is completely enclosed on all sides by the walls 244, 246, 248, 250. The opening 240 has a height 252 approximately equal to the height of the inner shroud 200 and/or inner flange 204. The opening 240 has a length 254 that is longer than a length of the inner shroud 200 and/or inner flange 204. The thickness of the mounting clip 114 may correspond to the thickness of the panel 102 to securely fit the mounting clip 114 between the panel 102 and the features of the cap housing 110 used to hold the mounting clip 114. The mounting clip 114 is slid sideways along the inner shroud 200 and the additional length 254 of the opening 240 allows the mounting clip 114 to slide relative to the cap housing 110.

The inner shroud 200 includes detents 256 spaced apart from the outer flange 202. In an exemplary embodiment, the detents 256 extend from the top 210 and the bottom 212; however the detents 256 may extend from other portions of the cap housing 110. The detents 256 are used to secure the mounting clip 114 to the cap housing 110.

The mounting clip 114 includes windows 258 aligned with the detents 256. The windows 258 are sized and shaped to allow the detents 256 to pass through when the mounting clip 114 is loaded onto the cap housing 110. The mounting clip 114 is loaded onto the cap housing 110 in a loading direction generally toward the outer flange 202. The mounting clip 114 is loaded onto the cap housing 110 behind the detents 256 against the panel 102. The windows 258 allow the mounting clip 114 to be loaded straight over the inner shroud 200 and allow the mounting clip 114 to be positioned behind the detents 256.

Figure 7:
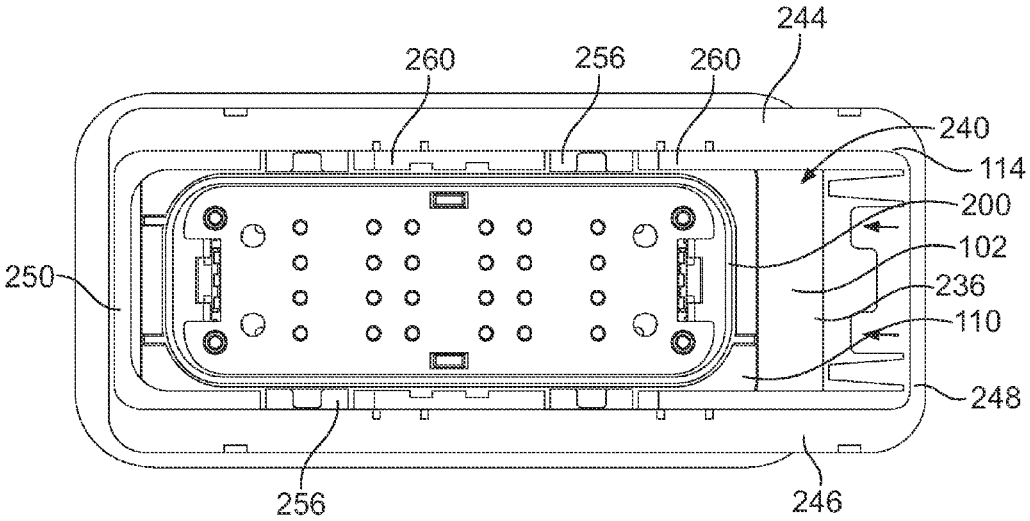
FIG. 7 illustrates the cap connector with the mounting clip in a loaded but unlocked position.

FIG. 7 illustrates the cap connector 104 with the mounting clip 114 in a loaded but unlocked position. In the loaded position, the mounting clip 114 is loaded over the inner shroud 200 and abuts against the front surface 234 of the panel 102. The mounting clip 114 is shifted to one side (e.g. to the right side) of the inner shroud 200 such that the inner shroud 200 is positioned proximate to the second side wall 250 and is positioned away from the first side wall 248.

The mounting clip 114 includes rails 260 extending from the upper wall 244 and the lower wall 246. The rails 260 are configured to engage the detents 256 extending from the cap housing 110 to secure the cap housing 110 to the panel 102. During assembly, the mounting clip 114 is slid in a securing direction along the panel 102 and the cap housing 110. In the illustrated embodiment, the mounting clip 114 is slid to the left such that the position of the inner shroud 200 within the opening 240 changes as the mounting clip 114 is moved in the securing direction. In an exemplary embodiment, the securing direction is generally parallel to the outer flange 202 and the panel 102. As the mounting clip 114 is moved in the securing direction, the rails 260 engage the detents 256. The rails 260 and/or the detents 256 are ramped or angled to drive the cap housing 110 forward, which snugs the outer flange 202 against the rear surface 236 of the panel 102. As the mounting clip 114 is slid in the securing direction, the mounting clip 114 is pressed generally toward the outer flange 202 decreasing the spacing between the outer flange 202 and the mounting clip 114. The outer flange 202 and the mounting clip 114 are pressed against the panel 102 to hold the cap housing 110 tightly against the panel 102.

Figure 8:
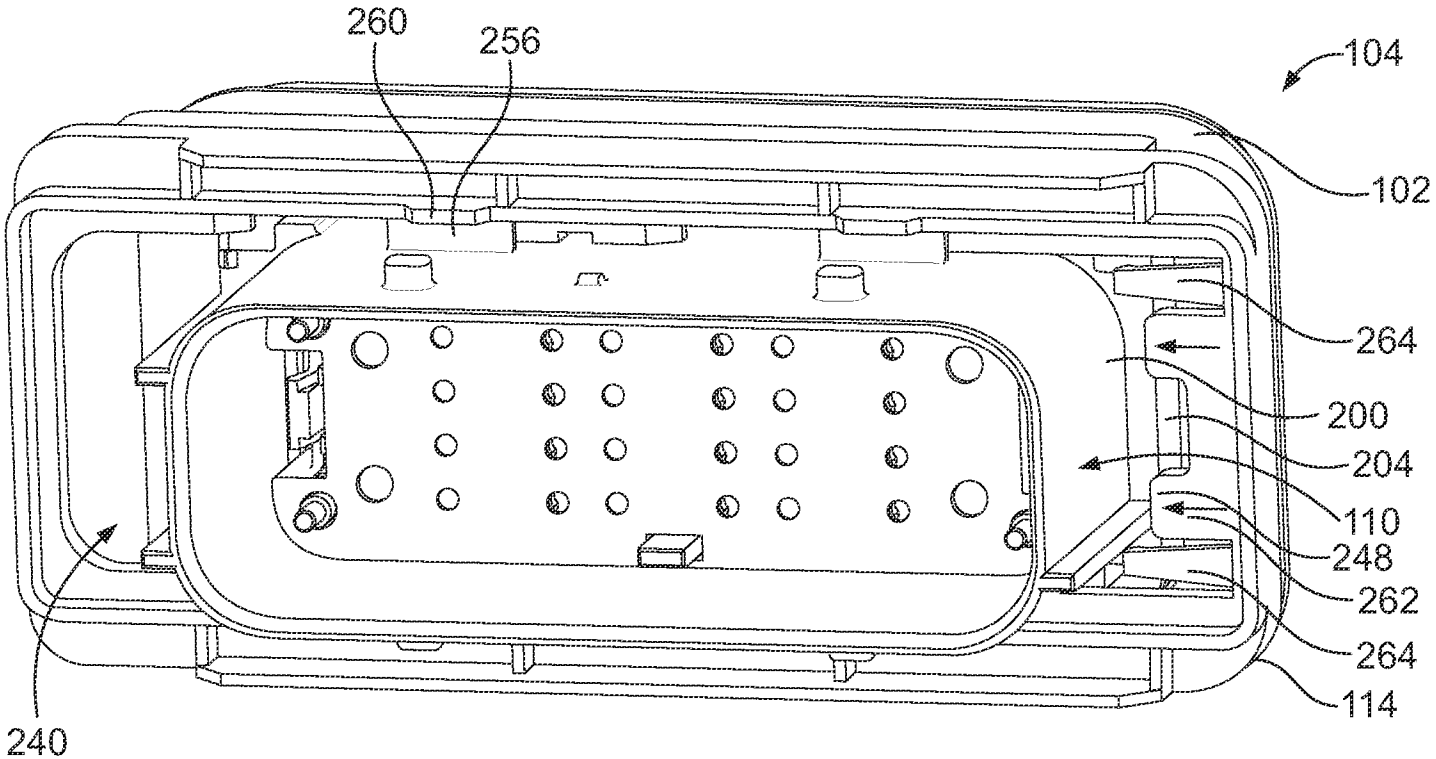
FIG. 8 illustrates the cap connector showing the mounting clip in a loaded and locked position.

FIG. 8 illustrates the cap connector 104 showing the mounting clip 114 in a loaded and locked position. The mounting clip 114 is shown after being slid sideways along the panel 102 to secure the cap housing 110 to the panel 102. In an exemplary embodiment, the mounting clip 114 includes a manual pad 262 that is used by the operator to push or press the mounting clip 114 in the securing direction. Latches 264 extending from the first side wall 248 on the mounting clip 114 engage the inner flange 204 to stop movement of the mounting clip 114 in the securing direction. The latches 264 position the mounting clip 114 with respect to the cap housing 110 in a locked position. In the locked position, the rails 260 engage the detents 256. Optionally, the detents 256 and/or rails 260 may be shaped to hold the mounting clip 114 in the locked position.

Once the cap connector 104 is securely coupled to the panel 102, the cap connector 104 is configured for mating with the plug connector 106 (shown in FIG. 1). Current mounting clips having a generally c-shaped design where the mounting clip is aligned extending from the side of the cap housing 110 to slide the open end of the c-shaped mounting clip onto the inner shroud 200. Unlike current c-shaped mounting clips, the closed mounting clip 114 is front loaded over the inner shroud 200 so that the inner shroud 200 fits within the opening 240. With the closed mounting clip design shown in FIGS. 6-8, significantly less space is required to position the mounting clip 114 onto the cap housing 110 as compared to c-shape mounting clips. The amount of clearance space needed to the side (e.g. to the right) of the cap connector 104 is greatly reduced by the closed mounting clip design of the mounting clip 114 as compared to the c shaped design of the other mounting clips. Other components may be positioned closer to the connector assembly 100 by using such a design.

Figure 9A:
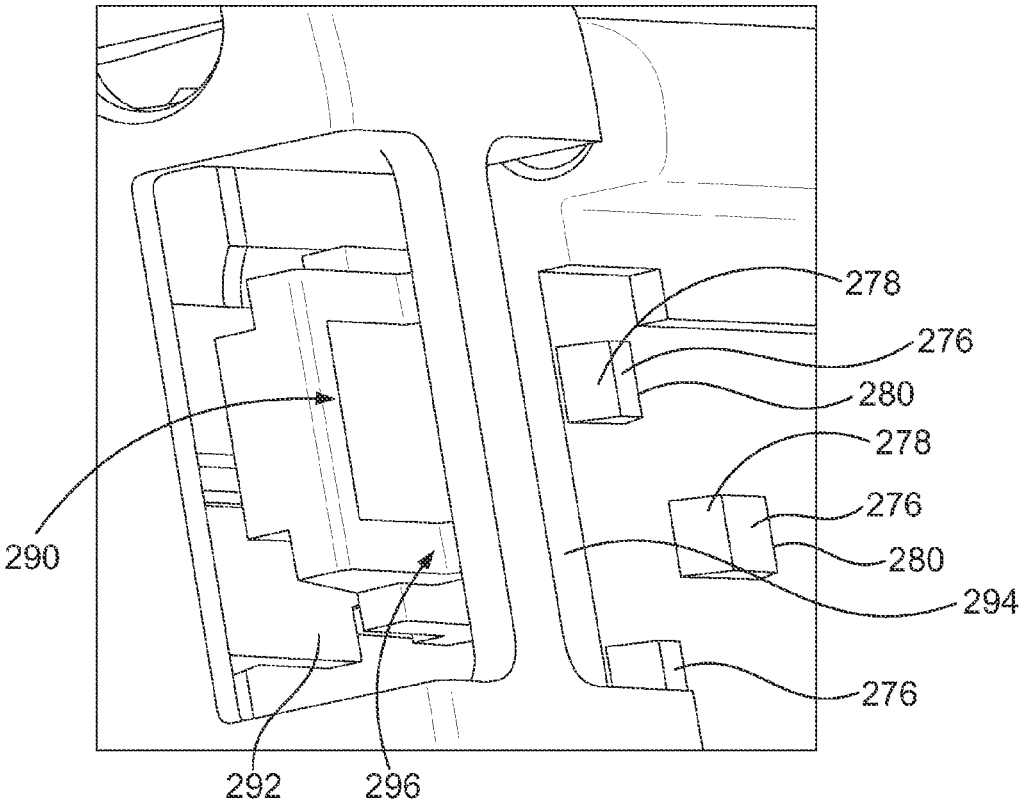
FIGS. 9*a* and 9*b* illustrate a portion of the cap connector showing a cap TPA device poised for mounting to a cap terminal block thereof.
Figure 9B:
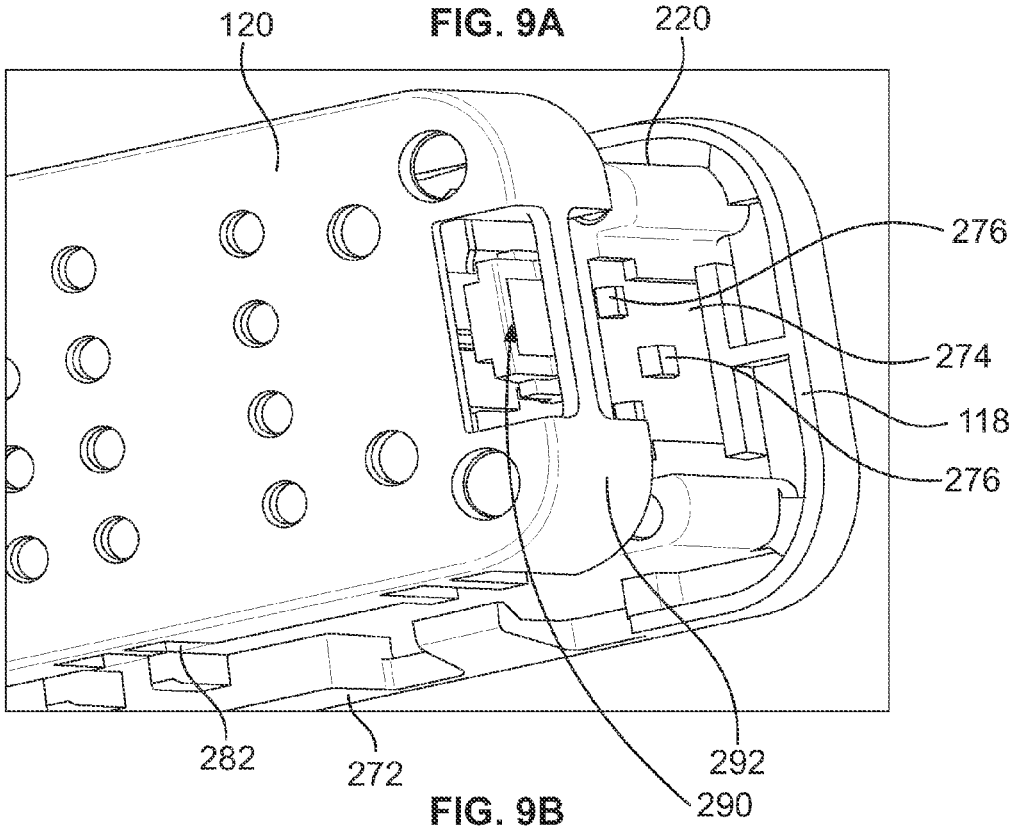

FIGS. 9*a* and 9*b* illustrate a portion of the cap connector 104 showing the cap TPA device 120 poised for mounting to the cap terminal block 118. The cap terminal block 118 includes a top 270, a bottom 272 and sides 274 (only one side 274 shown in FIGS. 9*a* and 9*b*) extending between the top 270 and the bottom 272. The cap terminal block 118 is elongated such that the top 270 and bottom 272 are longer than the sides 274. The cap terminal block 118 includes a plurality of detents 276 extending from the sides 274. The detents 276 are used to secure the cap TPA device 120 to the cap terminal block 118. The detents 276 include a ramp 278 and a catch surface 280. The ramps 278 are generally forward facing while the catch surfaces 280 are generally rearward facing.

In an exemplary embodiment, each side 274 of the cap terminal block 118 includes a plurality of detents 276 arranged in a staged configuration at different distances from a front 282 of the cap terminal block 118. For example, in the illustrated embodiment, the detents 276 are arranged at two stages with the catch surfaces 280 of the detents 276 at two different distances from the front 282. The near stage (e.g. closer to the front 282) includes two detents 276 vertically offset toward the top 270 and bottom 272, respectively. The far stage (e.g. further from the front 282) includes a single detents 276 approximately centered between the top 270 and the bottom 272. Each of the stages may include any number of detents 276. Any number of stages may be provided.

The stages of detents 276 are used to hold the cap TPA device 120 at different staged positions with respect to the cap terminal block 118. Staging of the cap TPA device 120 is used in assembly of the cap connector 104, such as for loading and unloading the cap terminals from the cap terminal block 118. For example, the cap terminals may only be loaded and unloaded from the cap terminal block 118 when the cap TPA device 120 is in a forward position, while insertion and removal of the cap terminals with respect to the cap terminal block 118 may be restricted when the cap TPA device 120 is in a rearward or locked position. The near detents 276 may be used to hold the cap TPA device 120 in the forward position while the far detents 276 may be used to hold the cap TPA device 120 in the rearward or locked position.

In an exemplary embodiment, the cap TPA device 120 includes hinged latches 290 extending from sides 292 of the cap TPA device 120 (only one latch 290 and side 292 is illustrated in FIGS. 9*a* and 9*b*, however a similar latch may be provided on the opposite side of the cap TPA device 120). The latches 290 each include a strap 294 supported by multiple hinges 296. The hinges 296 allow the strap 294 to rotate or move relative to the cap terminal block 118 to release the cap TPA device 120 from the cap terminal block 118. The hinges 296 define multiple connection points for connecting the latches 290 to the sides 292 of the cap TPA device 120. The cap TPA device 120 is coupled to the cap terminal block 118 such that the hinged latches 290 engage corresponding detents 276 of the cap terminal block 118.

The hinged latched 290 are configured to be released from the detents 276 to uncouple the cap TPA device 120 from the cap terminal block 118, such as to allow the cap TPA device 120 to move from the rearward or locked positioned to the forward position and/or to allow the cap TPA device 120 to be entirely removed from the cap terminal block 118. The support walls 156 (shown in FIG. 2*a*) are moved out of a blocking position when the cap TPA device 120 is uncoupled from the cap terminal block 118 and moved to the forward or unblocking position and/or entirely removed from the cap terminal block 118. In the unblocking or forward position, the latches 158 (shown in FIG. 2*a*) of the cap terminal block 118 are allowed to be released to remove the cap terminals from the cap terminal channels 154 (shown in FIG. 2*a*).

In an exemplary embodiment, the latches 290 distribute the stresses from securing the cap TPA device 120 to the cap terminal block 118 over a large surface area thus reducing stress concentrations for latch breakage. For example, providing multiple hinges 296 provides multiple connection points increasing the surface area of connection between the latches 290 and the cap TPA device 120. In an exemplary embodiment, the latches 290 have a rocker latch design rather than using a flexible wall which cannot be directly disengaged like a rocker latch. The hinges 296 provide both torsional and flexural hinge movements which spread the stresses out over a larger area and reduce stress concentrations that could lead to hinge fracture with some material.

Figure 10:
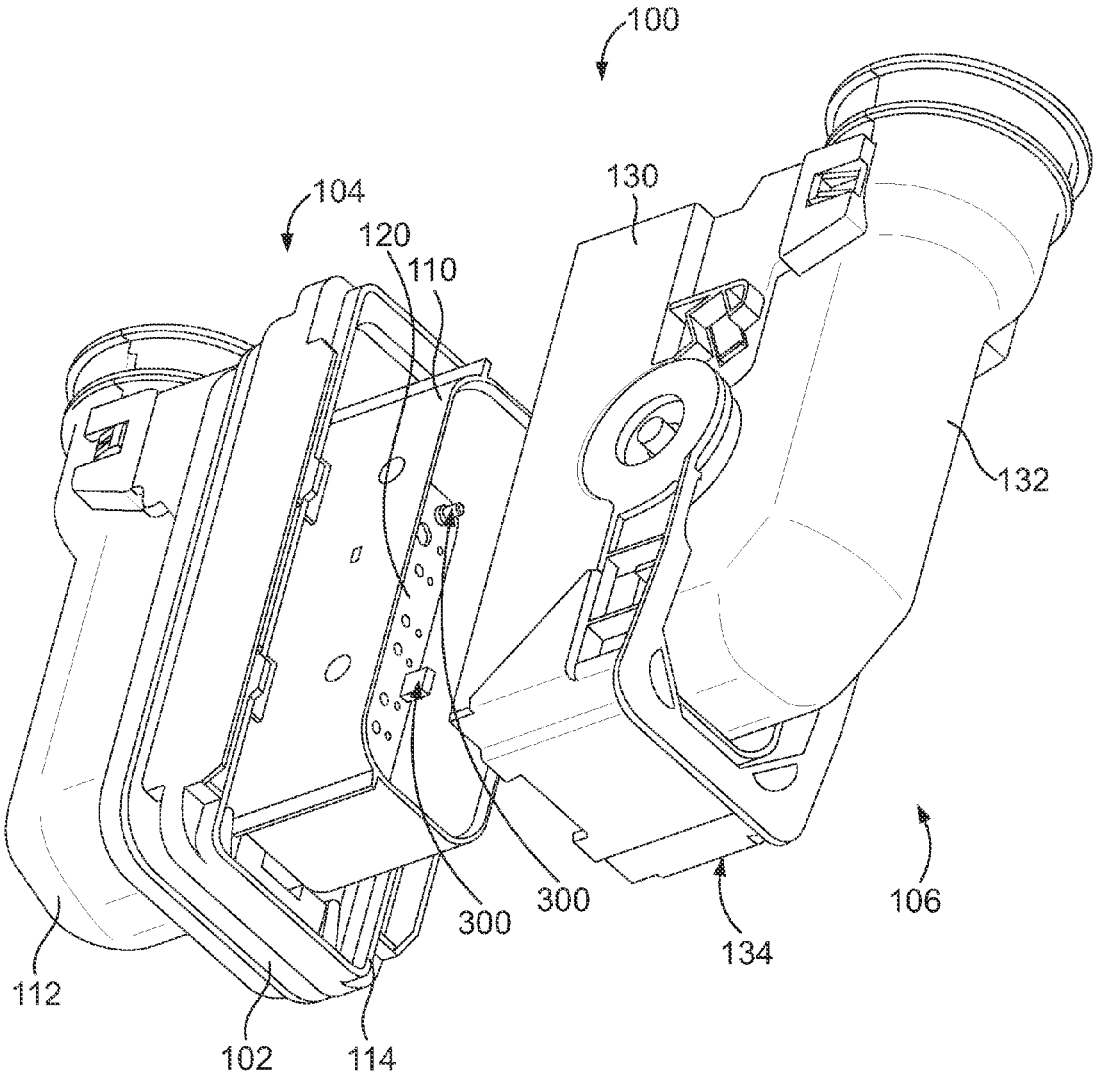
FIG. 10 is a partially exploded view of the connector assembly showing the plug connector poised for mating with the cap connector.
Figure 11:
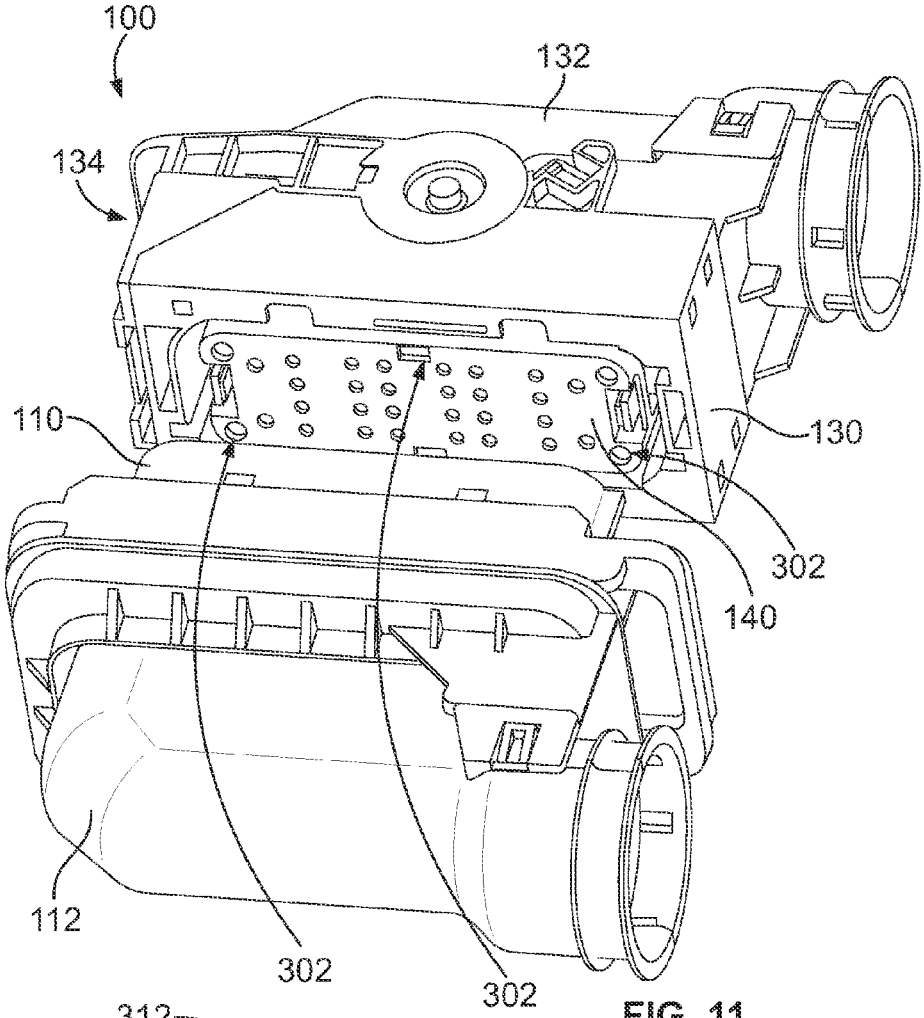
FIG. 11 is a partially exploded view of the connector assembly showing the plug connector poised for mating with the cap connector.

FIG. 10 is a partially exploded view of the connector assembly 100 showing the plug connector 106 poised for mating with the cap connector 104. FIG. 11 is a partially exploded view of the connector assembly 100 showing the plug connector 106 poised for mating with the cap connector 104. The cap and plug connectors 104, 106 are shown in assembled states.

The cap TPA device 120 is fully coupled to the cap terminal block 118 (shown in FIG. 2*a*) and received in the cap housing 110. The wire cover 112 is coupled to the cap housing 110. The mounting clip 114 is locked to secure the cap connector 104 to the panel 102. Similarly, the plug TPA device 140 is shown coupled to the plug terminal block 138 (shown in FIG. 2*b*). The plug TPA device 140 may be secured to the plug terminal block 138 in a similar manner as the cap TPA device 120. For example, the plug TPA device 140 may include hinged latches that are secured to detents extending from the plug terminal block 138. The wire cover 132 is coupled to the plug housing 130.

In the illustrated embodiment, the slide lock mechanism 134 is shown in an actuated position. The slide lock mechanism 134 is used to couple the plug connector 106 to the cap connector 104. The slide lock mechanism 134 may pull the plug connector 106 into the cap connector 104 as the slide lock mechanism 134 is actuated.

In an exemplary embodiment, the cap connector 104 includes a plurality of stabilizing post 300 extending from the cap terminal block 118. The stabilizing post 300 extend through the cap TPA device 120. In an exemplary embodiment, the stabilizing posts 300 are coupled to the cap terminal block 118. Optionally, the stabilizing post 300 may be integrally formed with the cap terminal block 118. In alternative embodiments, the stabilizing posts 300 are coupled to the cap housing 110 and extend through the cap terminal block 118 and cap TPA device 120. In other alternative embodiments, the stabilizing post 300 may be coupled to the cap TPA device 120 and extend therefrom into the cap terminal block 118 to locate the cap TPA device 120 with respect to the cap terminal block 118 during assembly.

The stabilizing posts 300 extend beyond the front of the cap TPA device 120 such that the stabilizing post 300 may extend into the plug connector 106. In an exemplary embodiment, the plug TPA device 140 and plug terminal block 138 include holes 302 extending therethrough that received the stabilizing post 300. When the plug connector 106 is coupled to the cap connector 104, the stabilizing post 300 extend into the holes 302. The stabilizing post 300 link together the cap terminal block 118, the cap TPA device 120, the plug TPA device 140, and the plug terminal block 138 to stabilize the connection between the plug terminals and the cap terminals. Effects of vibration of the connector assembly 100 are reduced at the interface between the plug terminals and cap terminals by tying together the cap terminal block 118 and the plug terminal block 138 which hold the cap terminals and plug terminals. Optionally, the stabilizing post 300 may be received in the holes 302 by an interference fit such that any movement of the cap terminal block 118 may be transferred to the plug terminal block 138, and vice versa, by the stabilizing post 300.

In the illustrated embodiment, the stabilizing post 300 and corresponding holes 302 are located in each of the corners of the terminal blocks 118, 138 as well as in a central position along the tops and bottom thereof. Other locations are possible in alternative embodiments. The stabilizing post 300 provide for vibration stabilization. In other embodiments, the stabilizing posts 300 may be used to just tie the terminal blocks 118, 138 together rather than the TPA devices 120, 140. For example, some embodiments may not include TPA devices 120, 140 or the stabilizing posts 300 may not directly engage and hold the TPA devices 120, 140.

Figure 12:
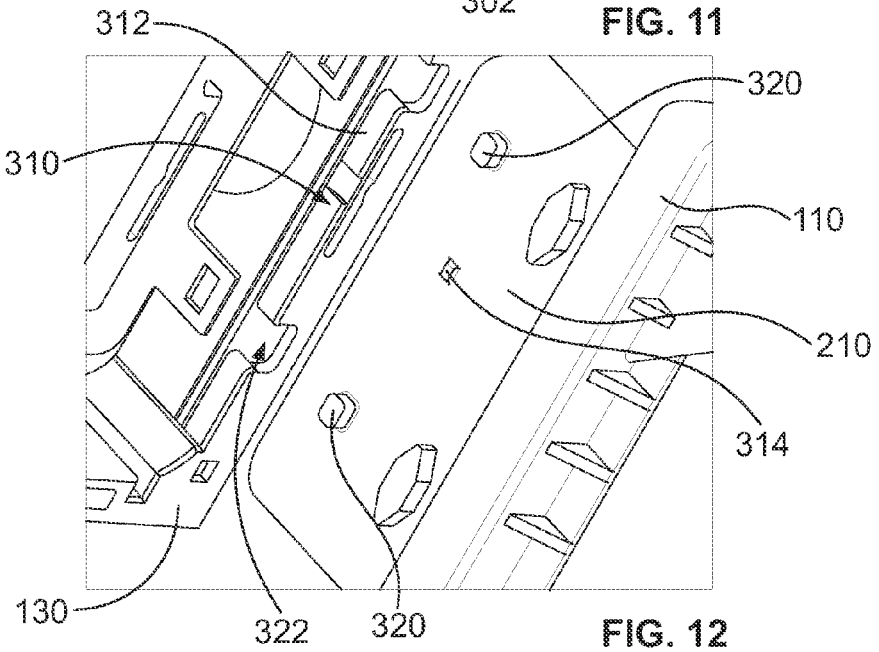
FIG. 12 illustrates a portion of the plug connector showing the cap housing and a plug housing of the plug connector.

FIG. 12 illustrates a portion of the plug connector 100 showing the cap housing 110 and the plug housing 130. Internal components of the plug connector 106 are removed for clarity to illustrate an interior wall surface of the plug housing 130. The plug housing 130 includes temporary retention latches 310 on the interior of the top and bottom of the plug housing 130. The temporary retention latches 310 are used to temporarily secure the plug housing 130 to the cap housing 110 during assembly prior to using the slide lock mechanism 134 (shown in FIG. 2*b*) to more permanently secure the plug connector 106 to the cap connector 104.

In the illustrated embodiment, the temporary retention latches 310 includes flexible straps 312 that are able to be deflected outward when the plug housing 130 is loaded over the cap housing 110. The cap housing 110 includes detents 314 extending from the top 210 and from the bottom 212 (shown in FIG. 3). The detents 314 cause the straps 312 to flex outward as the plug housing 130 is loaded over the cap housing 110. The detents 314 engage the back side of the straps 312 to temporarily secure the plug housing 130 to the cap housing 110. The securing force provided between the detents 314 and the temporary retention latches 310 is enough to support the plug housing 130 on the cap housing 110, however, such a securing force may be overcome by pulling the plug housing 130 off of the cap housing 110. The retention force between the detents 314 and the temporary retention latches 310 may be enough that the operator does not need to provide additional support to the plug housing 130 to retain the plug housing 130 temporarily on the cap housing 110. The slide lock mechanism 134 is used to more permanently secure the plug connector 106 to the cap connector 104.

In an exemplary embodiment, the cap housing 110 includes guide posts 320 extending from the top 210 and the bottom 212. When the plug housing 130 is coupled to the cap housing 110, the guide post 320 are loaded into the plug connector 106. The slide lock mechanism 134 engages the guide post 320 to secure the plug connector 106 to the cap connector 104. In an exemplary embodiment, the plug housing 130 includes openings 322 in the top and bottom of the plug housing 130. The guide post 320 past thru the openings 322 and into the slide lock mechanism 134.

With additional reference to FIGS. 2*a* and 2*b*, the slide lock mechanism 134 includes a pair of slide locks 330 and a lever 332 used to actuate the slide locks 330. The lever 332 causes the slide locks 330 to translate in a sliding direction within the plug housing 130. The slide locks 330 receive the guide post 320 (shown in FIG. 12). As the slide locks 330 move in the sliding direction, the slide locks 330 force the guide post 320 along a predefined path which pulls the plug connector 106 onto the cap connector 104. As the lever 332 is actuated, the plug connector 106 is pulled into the cap connector 104. As the plug connector 106 is pulled into the cap connector 104, the plug terminals mate with the cap terminals. The mating force between the many plug and cap terminals is overcome by the force exerted by the lever 332 to tighten down the plug connector 106 to the cap connector 104.

Embodiments of a panel mounted connector assembly include a series of retention latches to hold a cap connector into a panel mounting opening so a securing device can be applied on the other side of the panel. The retention latches temporarily retain the cap connector in the panel mounting opening so a single operator can insert and then move around to the other side of the panel to secure it in place. The retention features retain the cap connector and a lever or plug connector in position so an operator can remove their hand and re-grip the lever assist handle to complete the mating sequence. In an exemplary embodiment, one panel retention feature can accommodate multiple panel thicknesses.

Embodiments of a panel mounted connector assembly provide a tool-less mounting process that does not occupy a large access area in the process, provides terminal block-to-terminal block direct contact thus stabilizing one to the other, allows for release of the terminal position assurance (TPA) latches for ease of use, and provides a low-stress hinge design that will work with a wide variety of materials.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for mounting to a panel comprising:

a cap connector having a cap housing and a cap terminal block held in the cap housing and holding a plurality of cap terminals;

wherein the cap housing includes an inner shroud, an inner flange surrounding the inner shroud and an outer flange extending outward from the inner flange, the inner flange having panel retention features extending therefrom, the inner shroud being loaded through an opening in the panel until the panel retention features engage the panel and temporarily secure the cap housing to the panel between the panel retention features and the outer flange; and a mounting clip coupled to the cap housing after the panel retention features engage the panel and temporarily secure the cap housing to the panel, the mounting clip securing the cap housing to the panel by capturing the panel between the mounting clip and the outer flange.

2. The connector assembly of claim 1, wherein the inner shroud includes detents spaced apart from the outer flange, the mounting clip being loaded over the inner shroud until the mounting clip is positioned against the panel, the mounting clip being slid along the panel to engage the detents and secure the cap housing to the panel.

3. The connector assembly of claim 1, wherein the cap housing is more securely coupled to the panel by the mounting clip as compared to the panel retention features.

4. The connector assembly of claim 1, wherein the panel retention features include a plurality of ribs independently movable with respect to one another and detents extending from corresponding ribs, the detents being configured to engage the panel to secure the cap housing to the panel.

5. The connector assembly of claim 1, wherein the panel retention features are staged at different distances from the outer flange to accommodate different panel thicknesses.

6. The connector assembly of claim 1, further comprising a cap terminal position assurance (TPA) device held in the cap housing, the cap terminal block having terminal channels receiving the cap terminals, the cap terminal block having deflectable latches securing the cap terminals in the terminal channels, the cap terminal block having detents extending from sides of the cap terminal block, the cap TPA device having support walls extending into the cap terminal block to support the latches and restrict release of the latches when the support walls are in a blocking position, the cap TPA device having hinged latches coupled to sides of the cap TPA device, the cap TPA device being coupled to the cap terminal block such that the hinged latches engage corresponding detents of the cap terminal block, the hinged latches being configured to be released from the detents to uncouple the cap TPA device from the cap terminal block, the support walls being moved out of the blocking position when the cap TPA is uncoupled from the cap terminal block allowing the latches of the cap terminal block to release to remove the cap terminals from the terminal channels.

7. The connector assembly of claim 1, further comprising a plug connector coupled to the cap connector, the plug connector comprising a plug housing and a plug terminal block held in the plug housing and holding a plurality of plug terminals, the plug housing being secured to the cap housing with the plug terminals mated with corresponding cap terminals;

wherein the cap terminal block includes stabilizing posts extending therefrom, the stabilizing posts of the cap connector extending into the plug terminal block to align and secure the cap terminal block to the plug terminal block within the cap housing.

8. A connector assembly for mounting to a panel comprising:

a cap connector having a cap housing, a cap terminal block held in the cap housing and holding a plurality of cap terminals, and a mounting clip coupled to the cap housing to secure the cap housing to the panel;

wherein the cap housing includes an inner shroud and an outer flange, the inner shroud being loaded through an opening in the panel until the outer flange engages the panel;

wherein the mounting clip is front loaded over the inner shroud in a loading direction generally toward the outer flange, the mounting clip being coupled to the cap housing to secure the cap housing to the panel such that the panel is captured between the mounting clip and the outer flange; and wherein the mounting clip is front loaded over the inner shroud in a loading direction until the mounting clip abuts the panel, the mounting clip being moved in a securing direction generally perpendicular to the loading direction, the securing direction being generally parallel to the outer flange, the mounting clip being pressed toward the outer flange as the mounting clip is moved in the securing direction.

9. The connector assembly of claim 8, wherein the mounting clip includes an opening therethrough bounded by an upper wall, a lower wall, a first side wall and a second side wall extending between the upper and lower walls, the inner shroud passing through the opening.

10. The connector assembly of claim 8, wherein the inner shroud includes detents spaced apart from the outer flange, the mounting clip being loaded over the inner shroud until the mounting clip is positioned against the panel, the mounting clip being slid along the panel to engage the detents and secure the cap housing to the panel.

11. A connector assembly for mounting to a panel comprising:

a cap connector comprising a cap housing configured to be secured to the panel, a cap terminal block held in the cap housing and holding a plurality of cap terminals and a cap terminal position assurance (TPA) device held in the cap housing;

the cap terminal block having terminal channels receiving the cap terminals, the cap terminal block having deflectable latches securing the cap terminals in the terminal channels, the cap terminal block having detents extending from sides of the cap terminal block;

the cap TPA device having support walls extending into the cap terminal block to support the latches and restrict release of the latches when the support walls are in a blocking position, the cap TPA device having hinged latches coupled to sides of the cap TPA device, the cap TPA device being coupled to the cap terminal block such that the hinged latches engage corresponding detents of the cap terminal block, the hinged latches being configured to be released from the detents to uncouple the cap TPA device from the cap terminal block, the support walls being moved out of the blocking position when the cap TPA is uncoupled from the cap terminal block allowing the latches of the cap terminal block to release to remove the cap terminals from the terminal channels.

12. The connector assembly of claim 11, wherein the latches each include a strap supported by multiple hinges, the strap engaging the corresponding detents.

13. The connector assembly of claim 11, wherein the latches are connected to the corresponding sides at multiple connection points.

14. The connector assembly of claim 11, wherein each side of the cap terminal block includes a plurality of detents arranged in a stacked configuration at different distances from a front of the cap terminal block, the latches engaging the detents to hold the cap TPA at different staged positions.

15. A connector assembly for mounting to a panel comprising:

a cap connector comprising a cap housing and a cap terminal block held in the cap housing and holding a plurality of cap terminals, the cap terminal block having stabilizing posts extending therefrom;

a plug connector coupled to the cap connector, the plug connector comprising a plug housing and a plug terminal block held in the plug housing and holding a plurality of plug terminals, the plug housing being secured to the cap housing with the plug terminals mated with corresponding cap terminals and with the stabilizing posts of the cap connector extending into the plug terminal block to align and secure the cap terminal block to the plug terminal block within the cap housing; and a cap TPA device coupled to the cap terminal block and a plug TPA device coupled to the plug terminal block, the stabilizing posts extend through the cap TPA device and the plug TPA device, the stabilizing posts link together the plug TPA device and cap TPA device with the plug terminal block and the cap terminal block.

16. The connector assembly of claim 15, wherein the stabilizing posts link together the cap terminal block and the plug terminal block to stabilize the connections between the plug terminals and the cap terminals.

17. The connector assembly of claim 15, wherein the stabilizing posts are coupled to the cap terminal block.

18. The connector assembly of claim 15, wherein the stabilizing posts are coupled to the cap housing and extend through the cap terminal block.

19. The connector assembly of claim 15, wherein the stabilizing posts guide mating of the plug connector and the cap connector.

20. The connector assembly of claim 15, wherein the plug housing includes temporary retention latches and the cap housing includes detents engaging the temporary retention latches to secure the cap connector to the plug connector, the plug connector further comprises a slide lock mechanism having a slide lock engaging the cap housing to secure the cap connector to the plug connector, the slide lock mechanism comprising a lever to actuate the slide lock.

* * * * *